US011318061B2

(12) United States Patent
Houde

(10) Patent No.: US 11,318,061 B2
(45) Date of Patent: May 3, 2022

(54) FUNERAL TRAY

(71) Applicant: CERCUEILS CONCEPT INC., St-Édouard de Lotbinière (CA)

(72) Inventor: Jean-François Houde, Laurier-Station (CA)

(73) Assignee: CERCUEILS CONCEPT INC., St-Édouard de Lotbinière (CA)

( * ) Notice: Subject to any disclaimer, the term of this patent is extended or adjusted under 35 U.S.C. 154(b) by 0 days.

(21) Appl. No.: 16/715,355

(22) Filed: Dec. 16, 2019

(65) Prior Publication Data

US 2021/0106485 A1 Apr. 15, 2021

Related U.S. Application Data

(60) Provisional application No. 62/915,270, filed on Oct. 15, 2019.

(51) Int. Cl.
*A61G 17/007* (2006.01)
*A61G 17/00* (2006.01)
*A61G 17/02* (2006.01)

(52) U.S. Cl.
CPC ..... *A61G 17/0106* (2017.05); *A61G 17/004* (2016.11); *A61G 17/0073* (2013.01); *A61G 17/034* (2017.05)

(58) Field of Classification Search
CPC ..... A61G 17/0106; A61G 17/004; A61G 17/034; A61G 17/0073; A61G 17/001; A61G 17/04; A61G 17/042; A61G 17/044; A61G 17/02; A61G 17/041; A61G 17/047; B27N 3/20; B27N 5/00; B27N 5/02
USPC ..... 27/2, 4, 12, 14, 19, 35
See application file for complete search history.

(56) References Cited

U.S. PATENT DOCUMENTS 4,320,562 A 3/1982 Kelly
4,951,367 A * 8/1990 Wolfe ..... A61G 17/042 27/19
5,092,020 A * 3/1992 MaGuire ..... A61G 17/047 27/19
5,444,900 A * 8/1995 Shawhan ..... A61F 5/485 27/19
5,485,661 A 1/1996 McClure
5,615,464 A * 4/1997 Rojdev ..... A61G 17/04 27/19
5,775,061 A * 7/1998 Enneking ..... A61G 17/00 53/445
5,815,898 A * 10/1998 Jenkins ..... A61G 17/004 27/4
6,145,175 A * 11/2000 Enneking ..... B65D 5/22 27/19
7,003,855 B2 2/2006 Lew
7,204,003 B2 * 4/2007 Davis ..... A61G 17/001 27/2

(Continued)

FOREIGN PATENT DOCUMENTS

GB 2139944 A * 11/1984 ..... B27N 7/00

*Primary Examiner* — William L Miller
(74) *Attorney, Agent, or Firm* — Norton Rose Fulbright Canada LLP; Alexandre Daoust

(57) ABSTRACT

The funeral tray can have an elongated bottom and an upwardly projecting wall peripheral to the bottom and leading to a raised rim, defining a concave shape sized and configured to receive the body of a deceased person, the upwardly projecting wall and the bottom being integral to one another and made of bio-based material.

28 Claims, 7 Drawing Sheets

(56) References Cited

U.S. PATENT DOCUMENTS

| | | | | |
|---|---|---|---|---|
| 7,322,079 | B2 | 1/2008 | Davis et al. | |
| 8,104,152 | B2 * | 1/2012 | Spiers | A61G 17/047 27/19 |
| 8,997,319 | B2 * | 4/2015 | Jenson | A61G 17/00 27/4 |
| 9,649,240 | B2 * | 5/2017 | Cox | A61G 17/041 |
| 2005/0050701 | A1 * | 3/2005 | Davis | A61G 17/001 27/28 |
| 2006/0005364 | A1 * | 1/2006 | Davis | A61G 17/04 27/19 |
| 2012/0047700 | A1 * | 3/2012 | Kelly | A61G 17/0073 27/2 |
| 2014/0026378 | A1 * | 1/2014 | Gessel | B65D 5/64 27/4 |
| 2014/0123450 | A1 * | 5/2014 | Jenson | A61G 17/00 27/14 |
| 2014/0230203 | A1 * | 8/2014 | Cox | A61G 17/041 27/4 |
| 2016/0235611 | A1 * | 8/2016 | Davis | A61G 17/044 |
| 2017/0281448 | A1 * | 10/2017 | Davis | A61G 17/02 |
| 2018/0021977 | A1 * | 1/2018 | Homann | B27N 5/00 428/182 |
| 2018/0338878 | A1 * | 11/2018 | Arlitt | A61G 17/034 |
| 2020/0146920 | A1 * | 5/2020 | Davis | A61G 17/001 |
| 2020/0237598 | A1 * | 7/2020 | Chan | B27N 3/20 |

* cited by examiner

FUNERAL TRAY

BACKGROUND

A variety of funeral rites exist, and beliefs and practices can differ depending on the culture and/or religion of the bereaved. In some ceremonies, the corpse of the deceased is placed in a casket. The casket can be used to carry the corpse with decorum, or to expose the deceased to the close ones during a visitation, for instance. In some other practices, the corpse of the deceased is cremated or otherwise destroyed, and caskets may not be used in such circumstances.

It will be understood that many families find it important for caskets to be to the image of their appreciation of the deceased, and as such, caskets are typically manufactured with significant care, and can be relatively expensive. Moreover, the environmental impact of the funeral is a factor which has gained in importance over recent years. The cost and environmental impact of a casket is typically avoided in funerals which do not involve one, though other costs can be incurred, such as the cost of a cremation urn which is used to hold the ashes of the deceased, and often designed to be exposed, for instance. To avoid or attenuate the cost and environmental considerations associated to single-use caskets, some funerals use a rental casket with a personalized sheet kit.

A final viewing of the corpse by the closest relatives is sometimes required, or otherwise desired, independently of the selected type of funeral ceremony. For instance, it may be required for a close relative to identify the deceased, or it may be desired by the closest relatives to view the corpse one last time before cremation, to name two examples. It may not be considered desirable to use a casket to this end, which limits the amount of decorum available in the circumstances. However, the exposure of an unprepared corpse on a stainless steel table may leave an unpleasant memory to the closest relatives. There was also a need for a means of carrying the deceased with decorum in situations where caskets were not used, for instance. Accordingly, there remained room for improvement.

SUMMARY

It was desired to provide a cost-efficient way of providing a certain degree of decorum for circumstances such as a final viewing of the corpse by one or more close relatives, or during burials following exposure using a rental casket, for instance. Preferably, the solution would be useable not only in static exposures, but would also be useable when carrying the corpse, which requires a certain level of rigidity and imposes a design pressure to limit weight. It was found that at least some needs could be satisfactorily addressed by providing a funeral tray manufactured of bio-based material. The funeral tray can be designed in a manner to have a relatively low weight and a rigidity sufficient to safely carry the corpse. The funeral tray can be designed in a manner to allow exposing the corpse, and be adapted to receiving a cover. The cover can be designed in two halves, for instance, which can be selectively engageable or disengageable from the funeral tray in a manner to selectively expose or cover an upper body of the corpse, for instance.

Accordingly, in accordance with one aspect, there is provided a funeral tray having an elongated bottom and an upwardly projecting wall peripheral to the bottom and leading to a raised rim, defining a concave shape sized and configured to receive the body of a deceased person, the upwardly projecting wall and the bottom being integral to one another and made of bio-based material.

Indeed, in some embodiments, the funeral tray is made of a single moulded part, leading to the integral wall and bottom, and can thus be referred to as having a unibody, or being monohull, for instance.

In accordance with another aspect, there is provided a funeral tray made of press-moulded fiberboard.

Although some types of fiberboard may be better adapted to some embodiments, the expression fiberboard as used herein is used generally to encompass engineered wood products made of wood fibers, including particleboard, low-density fiberboard (LDF), medium-density fiberboard (MDF), and hardboard (high-density fiberboard, HDF). In some embodiments described below, the wood fibers are obtained from wood particles generally in the millimetre-centimeter length range, and is moulded using a press, thus being perhaps best described as press-moulded particleboard. Fiberboard typically includes mostly wood fibers (wood dust, wood particles), but can include a significant amount of resin such as urea-formaldehyde resins or phenol formaldehyde resin, even though some fiberboards, such as some HDFs for instance, may be manufactured with sufficient amounts of pressure to avoid the use of resins. Fiberboards typically include relatively small amounts of salt and wax as known in the art. Other bio-based materials can be used in alternate embodiments, such as using plants as a source of fiber instead of wood for instance.

Many further features and combinations thereof concerning the present improvements will appear to those skilled in the art following a reading of the instant disclosure.

DESCRIPTION OF THE FIGURES

In the figures,

FIG. 3 is a top plan view of the funeral tray with arrows schematizing air circulation along the grooves;

DETAILED DESCRIPTION

Figure 1A:
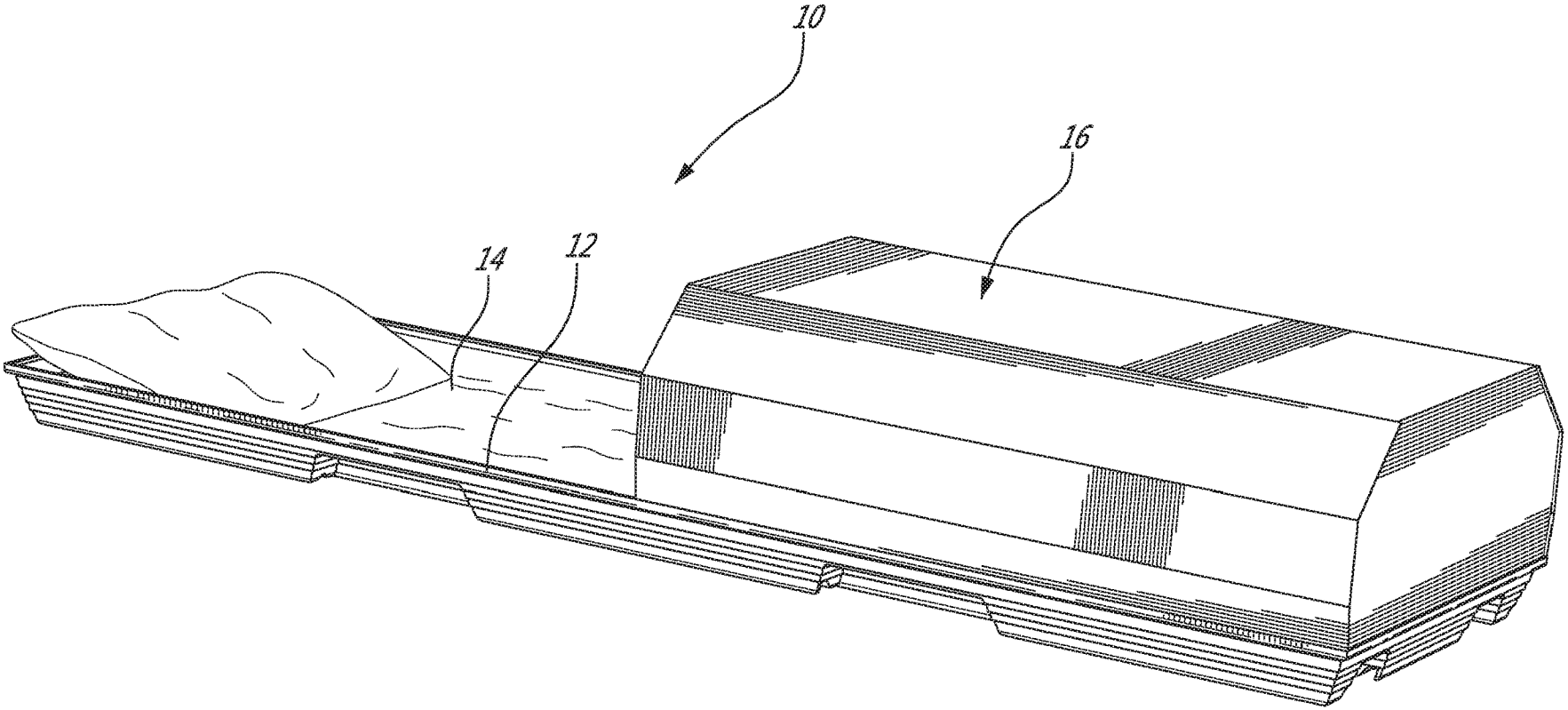
FIGS. 1A and 1B are oblique views of a casket including a funeral tray, bedding, and a cover, in FIG. 1A, one half of the cover is removed for exposure.
Figure 1B:
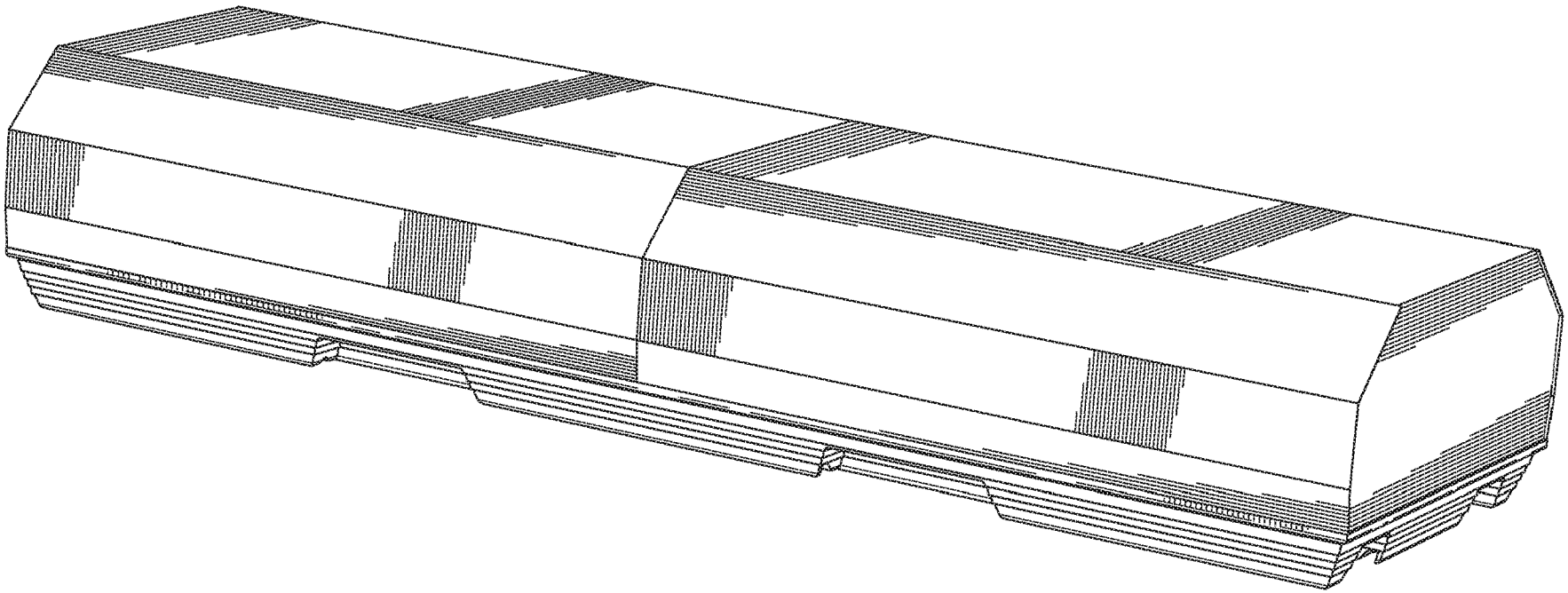

FIGS. 1A and 1B show an example of casket 10 comprised of a funeral tray 12, bedding 14 including a mattress, a pillow and linens, and a cover 16. A deceased person can be laid down onto the bedding in a natural position. The cover 16 is comprised of two halves. In FIG. 1A, a first cover half is assembled to a first longitudinal half of the funeral tray 12, which can cover the legs of the deceased person while leaving the upper body exposed, for viewing, for instance. In FIG. 1B, a second cover half is assembled to a second longitudinal half of the tray 12 to entirely cover the deceased person. The configuration of FIG. 1B can be used when carrying the deceased person, for instance.

The funeral tray 12 can be sold or used alone, or otherwise independently from associated articles.

Figure 2B:
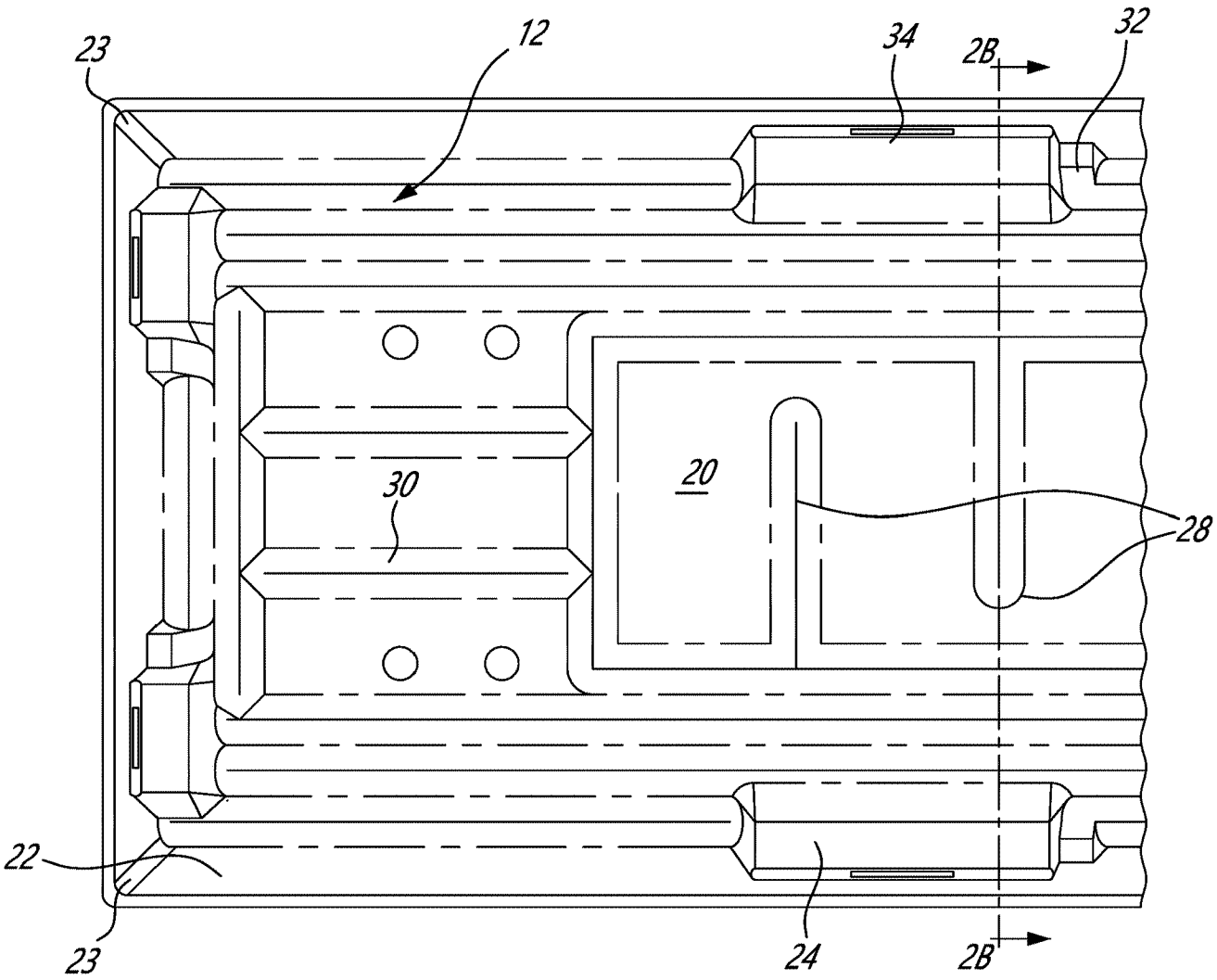
FIG. 2B is a cross-sectional view taken along lines 2B-2B of FIG. 2A.
Figure 2A:
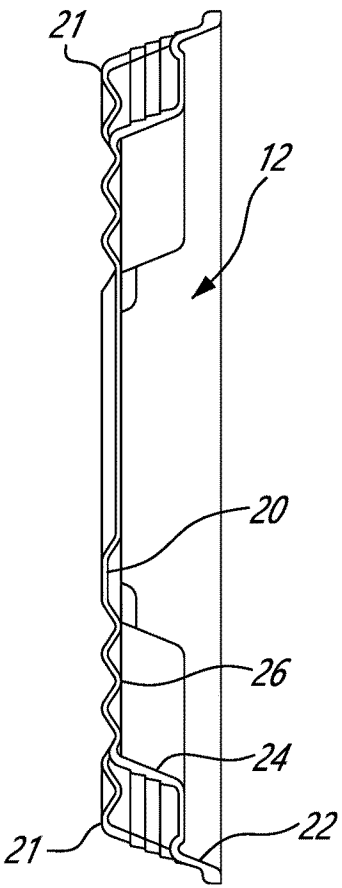
FIG. 2A is a partial top plan view of the funeral tray of FIG. 1.

FIGS. 2A and 2B show the funeral tray 12 alone, in greater detail. The funeral tray 12 can generally be provided with an elongated bottom 20 (best viewed in its whole in FIG. 3) and an upwardly projecting wall 22 peripheral to the bottom 20. The peripheral wall 22 leads to a raised rim. The funeral tray generally has a concave shape sized and configured to receive the body of a deceased person, and can have roughly 2 feet in width and 6.5 feet in length, for instance. The wall in this embodiment has a height of roughly 3 inches and is continuous, but can be discontinuous in alternate embodiments.

The tray 12 can be made of a single moulded part of bio-based material, and can thus be said to have a unibody, or to be monohull. More specifically, in this embodiment, the tray is made of a single press-moulded fiberboard component. In one example, the press-moulded fiberboard component can consist mainly of wood fibers, which can be in the 5-15 mm length range in general, and bonded with a suitable resin forming a minor portion of the material. The tray can be entirely formed in one press-moulding step, the wall and the body thus forming a single part. Alternate embodiments can be made of other types of fiberboards.

The tray 12 is made of a sheet-like material which, although having a somewhat uniform thickness determined by the distance between the male and female portions of the mould (see FIGS. 5A and 5B), is embossed and shaped by the press to form a relatively complex shape. In this manner, the peripheral wall 22 can be integral to the bottom 20 via a jointless perimeter 21. More specifically, the sheet-like material can be said to bend upwardly between the bottom 20 and the peripheral wall 22, such that the jointless perimeter 21 is rounded. An integral, shaped, sheet-like material with a concave shape can be resistant to leakage of fluids which could become present in the tray.

The peripheral wall 22 can include two longitudinal wall portions, one on each side of the bottom, parallel to the length of the tray 12, and two transversal wall portions, one on each end of the bottom, transversal to the length of the tray 12, integrally joined to one another via jointless corners 23, which can further be rounded. The wall portions can be designed to give the impression that the deceased person is comfortably nested within the concave shape. The wall portions can extend upwardly from the jointless perimeter 21, and thus act somewhat as the flanges of an I-beam and provide a significant amount of rigidity to the tray. Rigidity can be desired if the tray is designed to carry the deceased person. To this latter end, the tray can further be provided with integrated handles, and in the illustrated embodiments, two handles are 24 provided in each one of the wall portions, positioned and interspaced from one another to allow to naturally and easily carry the funeral tray. The handles in the front and rear wall portions can help pulling the casket out of a hearse, for instance.

In this specific embodiment, the sheet like material of the tray is further provided with a plurality of grooves 26 in the bottom 20. The grooves can be designed to play one or both of the two following roles, for instance: 1) provide additional rigidity for a limited amount of extra weight and 2) provide fluid circulation passages under the tray, which can help reduce incineration time when the tray is used as a cremation tray. As shown in FIGS. 2A and 2B, in this embodiment, a number of elongated grooves were provided alongside both longitudinal wall portions and alongside both transversal wall portions, and were found to effectively increase the resistance of the walls. Additional grooves can be provided, and in particular, in this embodiment, a peripheral groove circumscribes a central portion of the bottom, alternating left-side to right-side oriented grooves 28 were provided which project transversally from corresponding longitudinal portions of the peripheral groove, along the length of the central portion of the bottom, and additional longitudinal grooves 30 are provided between the central portion and transversal grooves at each longitudinal end of the tray. The air circulation paths formed by such a groove configuration are schematized by arrows at FIG. 3.

Indeed, in the embodiment illustrated a combination of elongated grooves parallel to the lateral edges to impede lengthwise bending, elongated grooves parallel and adjacent to the transversal edges to impede transversal bending, and transversal grooves in the center section, between the elongated grooves which are parallel to the lateral edges, can further impede transversal bending.

Figure 4:
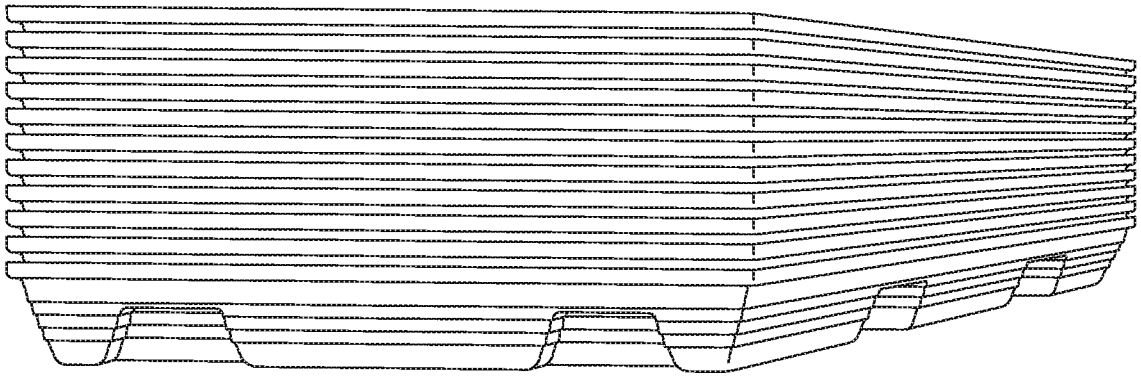
FIG. 4 is an oblique view showing a stack of funeral trays.

In the illustrated embodiment, the upwardly-projecting wall extends obliquely outwardly from the bottom, and is designed in a manner to allow identical trays to be stacked on top of one another into a configuration such as shown in FIG. 4. Stackability can reduce costs associated with shipping or storage, for instance. The bottom of the tray is thus narrower than its raised rim. To avoid jamming of the trays into one another due to the cumulative weight of the stacked trays, stop features can be included in the design of the tray, which can be used to maintain a spacing between the bottoms of superposed trays and prevent over-insertion of stacked trays. In this embodiment, a plurality of stops 32 are formed in the tray, in the form of thicker portions positioned at the intersection between the bottom and wall, interspaced from one another around the periphery of the bottom. More specifically, in this example, the stops 32 are incorporated into the handle design. When the trays are stacked, the stops stack on top of one another and essentially form corresponding columns forming a structure which holds the stacked trays in a practical manner.

Indeed, in one embodiment, the tray is stackable with identical trays. This can reduce costs as it can allow to address shipping volume. To this end, the trays can be provided with a stackable shape, which can include the lateral and end walls being outwardly oblique relative to the bottom, with the inner wall surface of a first tray being adapted to receive the outer wall surface of an other tray received into the first. To avoid a scenario where the weight of the stack of trays results in the jamming of two or more lowermost trays into one another, stop features can be incorporated into the moulded shape of the trays, preferably a plurality interspaced around the edges/walls perimeter, in a manner that the stop features prevent a tray stacked immediately above the first from reaching the bottom wall. When the trays are identical, the stop features become stacked on top of one another and structurally form a number of columns which supports the weight of the tray stack while maintaining a gap between the bottoms of adjacent trays in the stack.

Figure 2C:
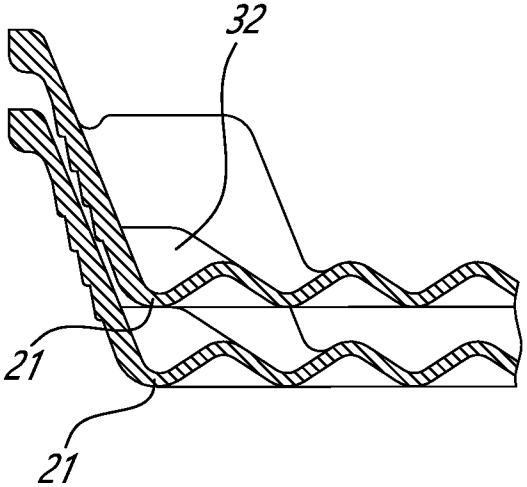
FIG. 2C is a cross-sectional view similar to FIG. 2B, schematizing the stacking of identical funeral trays.
Figure 5:
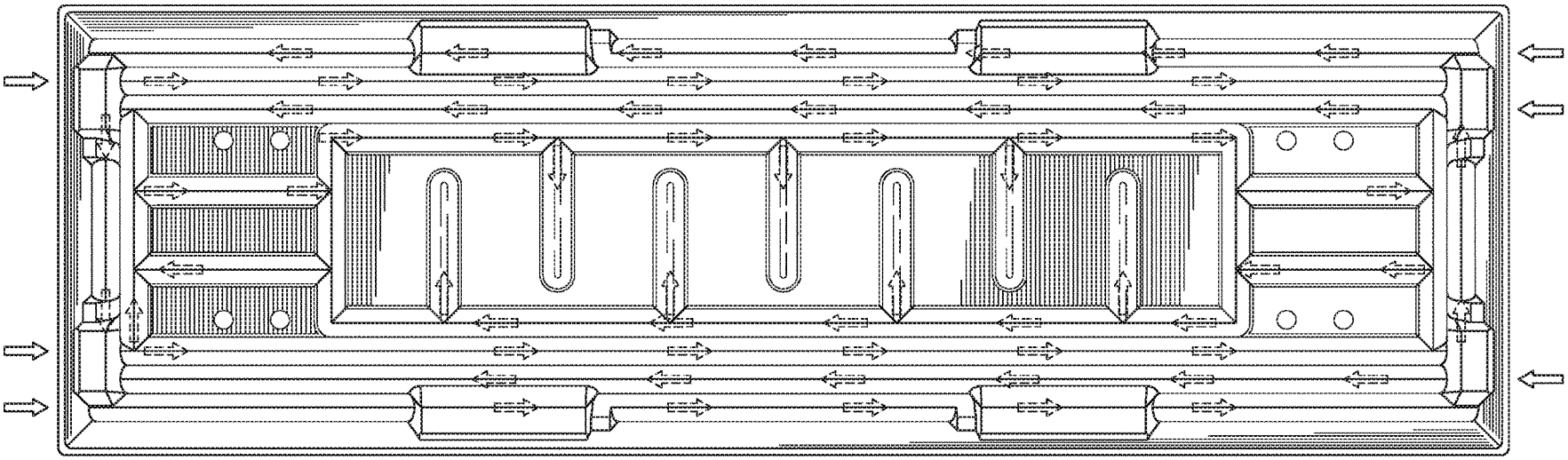
FIGS. 5A and 5B are oblique views showing a mould used to manufacture the funeral tray of FIG. 1.

In addition to the choice of the shape and the thickness of the sheet-like moulded material, the choice of the type of fiberboard can also affect the weight to rigidity ratio. In this context, rigidity can help limit deformation of the tray due to the weight of the deceased person when the deceased person is carried with the tray, for instance. In one example illustrated herein, a medium density fiberboard material tray was pressed from a mixture of roughly 89-91% wood fibers in the form of wood chips most of which having a length between 5 and 10 mm, or 5 and 15 mm for instance, and varying widths, 8-10% resin, small quantities of wax and salt, pressed with a 900 T press, achieving a pressure in the order of 1000 psi during pressing, with a total weight of about 25 pounds, to achieve a thickness of the pressed/embossed sheet-like material of between ⅛" and ⅜", preferably around 0.2 inches. Such an embodiment, having the groove configuration shown in FIGS. 2 and 3, was tested and found to satisfactorily resist deformation when carrying weight of up to 600 lbs. It was found that using a greater thickness with the same material and press, could lead to a weight capacity of up to 1000 lbs for a weight of 32 lbs, but the lower weight of the 600 lbs capacity configuration was preferred in a context where 600 lbs capacity at the trade-off of about 25 lbs weight was found satisfactory for most applications.

Figure 5B:
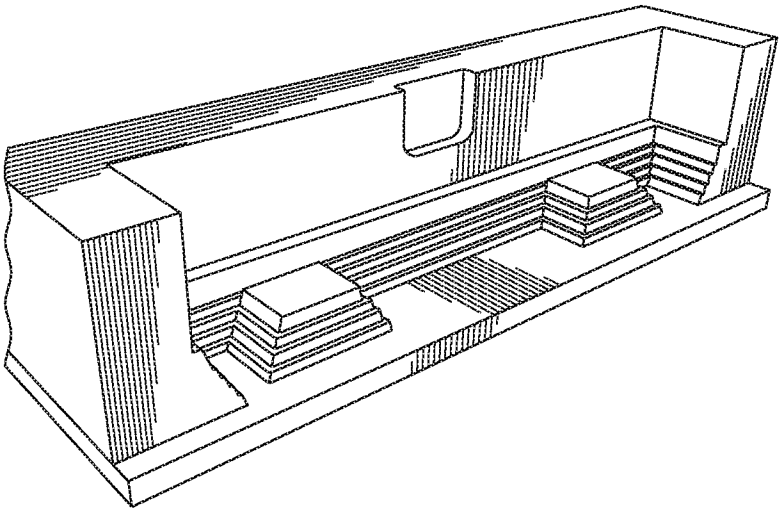
Figure 5A:
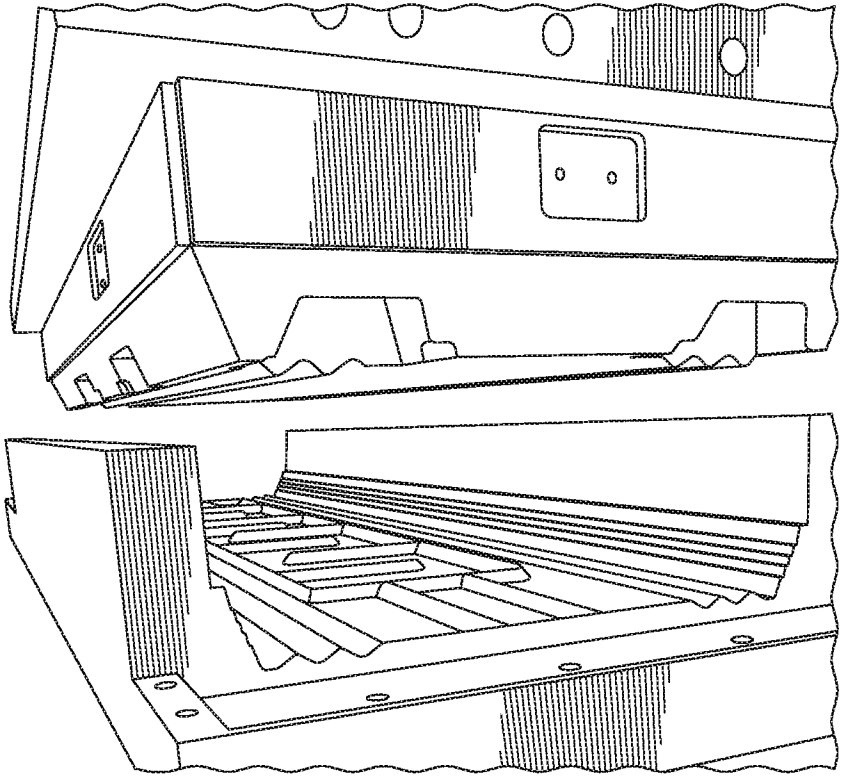

In the embodiment illustrated, the fiberboard body of the funeral tray, including the bottom and the walls, was press moulded using a mould shown in FIGS. 5A and 5B. The mould can be mounted to a press. In this embodiment, it was found relevant to use a bottom mould formed of a central portion and of two separable end portions, one of which is shown in FIG. 5B, whereas the upper mould was provided as a single component.

In this embodiment, the fiberboard body in unapertured except for slots 34 which were conveniently positioned here in corresponding ones of the handles, and which are configured to receive corresponding tabs of the cover. The cover halves can be made of cardboard and folded from corresponding blanks. In alternate embodiments, different tongue and slot arrangements can be used to secure the cover to the funeral tray, or the separable cover, if used, can be secured to the funeral tray in a variety of alternate ways.

As can be understood, the examples described above and illustrated are intended to be exemplary only. The scope is indicated by the appended claims.

What is claimed is:

1. A funeral tray having an elongated bottom and an upwardly projecting wall peripheral to the bottom and leading to a raised rim, defining a concave shape sized and configured to receive a body of a deceased person, the upwardly projecting wall having jointless corners and being integral to the bottom via a jointless perimeter, the funeral tray formed of a single, unibody part, and provided in the form of a monohull of particleboard moulded from a mixture of wood fibers and resin using a press, the funeral tray being resistant to leakage of fluids and configured to support the body of the deceased person when carried.

2. The funeral tray of claim 1 wherein the bottom has a portion comprised of a sheet having a uniform thickness and shaped with a plurality of grooves.

3. The funeral tray of claim 2 wherein the plurality of grooves include a plurality of grooves oriented parallel to a length of the elongated bottom.

4. The funeral tray of claim 2 wherein the plurality of grooves include a plurality of grooves oriented perpendicular to a length of the elongated bottom.

5. The funeral tray of claim 2 wherein the sheet bends upwardly at the periphery of the bottom and extends to form the upwardly projecting wall.

6. The funeral tray of claim 1 wherein the upwardly projecting wall includes longitudinal wall portions parallel to a length of the elongated bottom, on opposite sides of the elongated bottom.

7. The funeral tray of claim 6 wherein two interspaced handles are formed in each one of the longitudinal wall portions.

8. The funeral tray of claim 6 wherein the upwardly projecting wall includes transversal wall portions perpendicular to a length of the elongated bottom, at the opposite ends of the elongated bottom.

9. The funeral tray of claim 8 wherein two interspaced handles are formed in each one of the transversal wall portions.

10. The funeral tray of claim 8 wherein the bottom has a plurality of grooves oriented parallel to the length of the elongated bottom and located adjacent the longitudinal wall portions, and a plurality of grooves oriented perpendicular to the length of the elongated bottom and located adjacent the transversal wall portions.

11. The funeral tray of claim 10 wherein the bottom has a central portion including a plurality of grooves oriented transversal to the length of the elongated bottom and extending alternatingly from one of the longitudinal grooves located on one side of the bottom towards another one of the longitudinal grooves located on the other side of the bottom, and vice-versa, along the length of the bottom.

12. The funeral tray of claim 1 wherein the upwardly-projecting wall extends obliquely outwardly from the bottom, in a stackable configuration.

13. The funeral tray of claim 12 further comprising a plurality of stops interspaced around the periphery of the bottom, the stops configured to maintain a gap between the bottoms of superposed trays.

14. The funeral tray of claim 1 provided in combination with a cover, the cover being made of folded cardboard.

15. The funeral tray of claim 14 wherein cover includes two halves, each half covering a corresponding longitudinal portion of the tray.

16. The funeral tray of claim 14 wherein the cover is engaged with the tray via a tongue and slot arrangement.

17. The funeral tray of claim 1 further comprising a mattress laid against the bottom, within the upwardly projecting wall, and a pillow laid onto the mattress at one end of the bottom.

18. The funeral tray of claim 1 wherein the particleboard is an engineered wood product having roughly 9/10th in weight of wood chips generally in the 5-15 millimeter length range, and roughly 1/10th in weight of a suitable resin.

19. The funeral tray of claim 18, wherein the funeral tray weighs about 25 pounds and configured to carry the body of the deceased person having a weight up to 600 pounds.

20. The funeral tray of claim 1, wherein the bottom has a portion shaped with a plurality of grooves oriented perpendicular to a length of the elongated bottom, at least one of the grooves extending continuously between opposite ends of the elongated bottom.

21. The funeral tray of claim 1, wherein the particleboard has a thickness of between ⅛" and ⅜" after being press-moulded.

22. The funeral tray of claim 21, wherein the particleboard has a thickness of around 0.2 inches.

23. A process of making a funeral tray comprising:

press-moulding, between a lower mould portion and an upper mould portion, a mixture of wood fibers and resin in a manner to form a monohull of particleboard having an elongated bottom integrally joined to an upwardly projecting wall leading to a raised rim, the upwardly projecting wall peripheral to the bottom; and releasing the monohull of particleboard from the mould, the monohull of particleboard then constituting the funeral tray.

24. The process of making the funeral tray of claim 23, wherein said press-moulding includes applying a pressure in the order of 1000 psi.

25. The process of making the funeral tray of claim 23 wherein said particleboard is a medium density fiberboard.

26. The process of making the funeral tray of claim 23 wherein said wood fibers are in the form of wood chips having a length between 5 and 15 mm.

27. The process of making the funeral tray of claim 23 wherein the mixture of wood fibers and resin includes roughly 9/10th in weight of wood chips and roughly 1/10th in weight of a suitable resin.

28. The process of making the funeral tray of claim 23 wherein the mixture of wood fibers and resin includes roughly 89-91% of wood fibers and 8-10% of resin.

* * * * *